US010051900B2

(12) United States Patent
Carryl et al.

(10) Patent No.: US 10,051,900 B2
(45) Date of Patent: Aug. 21, 2018

(54) GARMENT

(71) Applicants: Cheryl Carryl, Bellwood, IL (US); Tania Thomas, Maywood, IL (US); Donnet Thomas, Addison, IL (US)

(72) Inventors: Cheryl Carryl, Bellwood, IL (US); Tania Thomas, Maywood, IL (US); Donnet Thomas, Addison, IL (US)

( * ) Notice: Subject to any disclaimer, the term of this patent is extended or adjusted under 35 U.S.C. 154(b) by 0 days.

(21) Appl. No.: 14/192,653

(22) Filed: Feb. 27, 2014

(65) Prior Publication Data

US 2015/0237932 A1 Aug. 27, 2015

(51) Int. Cl.
*A41D 13/12* (2006.01)

(52) U.S. Cl.
CPC ..... *A41D 13/129* (2013.01); *A41D 13/1254* (2013.01)

(58) Field of Classification Search
CPC ..... A41D 13/1254; A41D 2400/44
See application file for complete search history.

(56) References Cited

U.S. PATENT DOCUMENTS 1,512,171 A * 10/1924 Homling ..... A41B 9/08 2/78.2
4,446,575 A * 5/1984 Davis ..... A41D 13/1254 2/400
4,604,761 A * 8/1986 Wright ..... A41D 1/06 2/227
4,914,756 A * 4/1990 Grassick ..... 2/227
4,930,161 A * 6/1990 Cohen ..... A41D 13/1254 2/114
5,008,962 A * 4/1991 Smith et al. ..... 2/234
5,241,708 A * 9/1993 Rodarmel ..... 2/79
5,315,716 A * 5/1994 Baum ..... 2/227
5,706,523 A * 1/1998 Witzel ..... 2/238
5,802,611 A * 9/1998 McKenzie ..... A41D 13/1236 2/114
5,822,802 A * 10/1998 Chou ..... 2/227
5,918,310 A * 7/1999 Farahany ..... 2/23
5,926,851 A * 7/1999 Kovalik ..... 2/227
6,192,522 B1 * 2/2001 Schreib ..... A41D 1/065 2/227
6,243,878 B1 * 6/2001 Khemka ..... A41D 1/065 2/227
6,477,716 B2 * 11/2002 Blaire ..... 2/227
(Continued)

*Primary Examiner* — Richale Quinn
*Assistant Examiner* — Anne Kozak
(74) *Attorney, Agent, or Firm* — IP Patent Clinic The John Marshall Law School

(57) ABSTRACT

Certain embodiments of the invention may include a garment adaptable for self-donning and for donning by another onto a wearer. The garment may include two longitudinal panels. Each longitudinal panel may be operatively attached to each other. Each panel may have a waistband portion, a hip portion and a leg portion. Each longitudinal panel may terminate with a first and second cooperating and fastening material that may be disposed substantially along the longitudinal hip and leg portions. Each panel may be moveable between a substantially flat open position and a second closed wearable position where each first and second cooperating and fastening materials of each panel may join the second closed wearable position. The cooperating and fastening material may include continuous strips of cooperating materials that may include mating components.

6 Claims, 4 Drawing Sheets

(56) References Cited

U.S. PATENT DOCUMENTS 6,647,552 B1 * 11/2003 Hogan ..... 2/114
6,668,382 B1 * 12/2003 Wright ..... A61L 27/18 2/69.5
7,000,261 B1 * 2/2006 Loffredo ..... 2/400
7,100,214 B1 * 9/2006 Murray ..... A41C 1/003 2/406
7,810,172 B2 * 10/2010 Williams ..... A41D 13/1236 2/114
7,966,672 B1 * 6/2011 Hagerman et al. ..... 2/227
7,992,222 B1 * 8/2011 Behrens ..... A41B 1/00 2/118
8,087,098 B2 * 1/2012 Kimberly ..... A41B 9/001 2/227
D654,662 S * 2/2012 Lewis ..... D2/743
8,713,715 B1 * 5/2014 Lewis ..... A41D 1/065 2/227
D727,595 S * 4/2015 Lawson et al. ..... D2/743
9,089,173 B2 * 7/2015 Krishnan ..... A41D 1/06
D739,120 S * 9/2015 Young ..... D2/739
2003/0229930 A1 * 12/2003 Carlson ..... 2/114
2004/0010837 A1 * 1/2004 Graves ..... 2/114
2004/0261156 A1 * 12/2004 Lewis ..... A41D 1/06 2/227
2005/0108803 A1 * 5/2005 Ballard ..... 2/69
2006/0021115 A1 * 2/2006 Stanley ..... 2/400
2006/0156450 A1 * 7/2006 McGrath ..... 2/114
2006/0174394 A1 * 8/2006 Kelly ..... 2/114
2007/0199127 A1 * 8/2007 Coronado ..... 2/69
2007/0204376 A1 * 9/2007 Nunn ..... 2/69
2007/0245450 A1 * 10/2007 Feodoroff ..... 2/114
2007/0271670 A1 * 11/2007 Hwang et al. ..... 2/69
2009/0216305 A1 * 8/2009 Bonner ..... 607/108
2010/0235964 A1 * 9/2010 Mickey et al. ..... 2/228
2010/0299803 A1 * 12/2010 Ladra ..... 2/83
2011/0107496 A1 * 5/2011 Harris ..... 2/114
2011/0119814 A1 * 5/2011 Caliste ..... 2/400
2012/0053553 A1 * 3/2012 Griggs ..... 604/396
2012/0266349 A1 * 10/2012 Rolando ..... 2/80
2012/0317700 A1 * 12/2012 Vanderburgh ..... 2/237
2014/0020154 A1 * 1/2014 Roberts ..... 2/227
2014/0026293 A1 * 1/2014 Quistian, Jr. ..... 2/227
2014/0325734 A1 * 11/2014 Kuelker ..... 2/79

* cited by examiner

Fig. 3
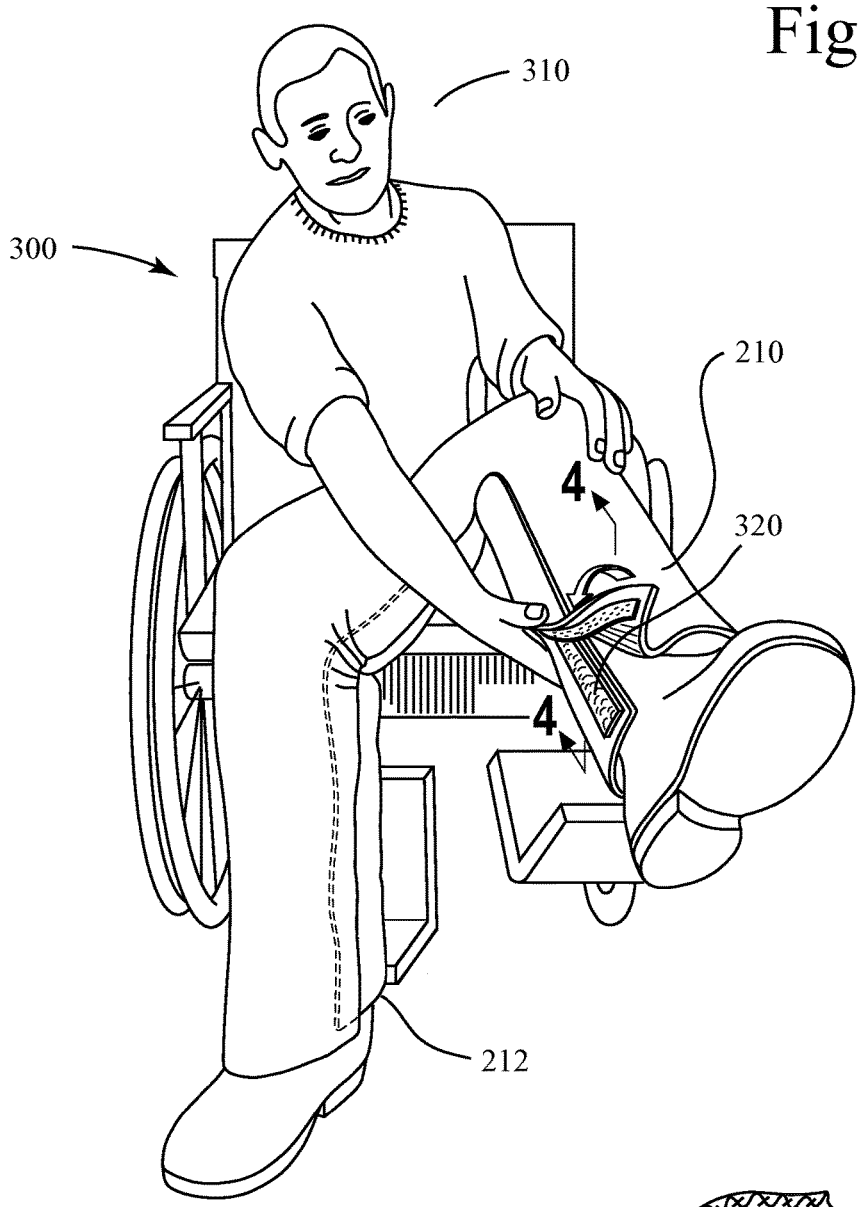
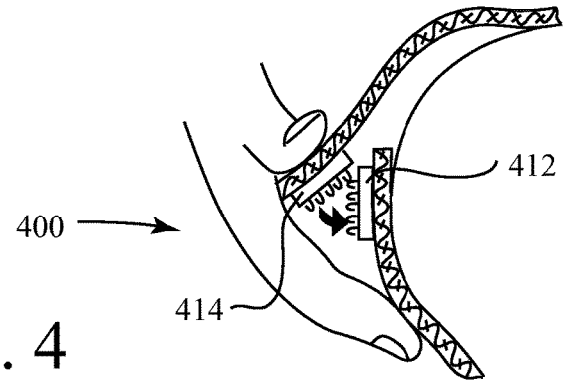
Fig. 4

GARMENT

This patent application is a continuation-in-part of U.S. patent application Ser. No. 13/897,304, filed on May 17, 2013, which claims priority to provisional application No. 61/648636, which was filed on May 18, 2012.

FIELD

Certain embodiments of the invention are generally related to articles of clothing adaptable for self-donning and/or donning and doffing by another onto a wearer.

BACKGROUND

Variety of garments exists on the market for self-donning or donning by another onto wearer. Some of these garments may be used by individuals with medical needs or those with certain physical challenges. Some of these garments allow easy access to certain parts of the body but require efforts by medical staff or the wearer. Other garments feature open designs allowing staff to quickly access bodily areas at the expense of privacy of patients.

Therefore there is a need for garments that allow easy access to body parts for treatment and medical or for personal use by the patient or other purposes while maintaining privacy and needless exposure. Certain embodiments for the invention provide such advantage as well as other advantages.

Certain embodiments of the invention may include garments adaptable for self-donning and for donning by another onto a wearer. For example, a garment according to certain embodiments, may include two longitudinal panels. Each longitudinal panel may be operatively attached to each other. Each panel may have a waistband portion, a hip portion and a leg portion. Each longitudinal panel may include at least one cooperating and fastening material that may be disposed substantially along the longitudinal hip and leg portions. Each panel may be moveable between a substantially flat open position and a second closed wearable position where each first and second cooperating and fastening materials of each panel may join to form outer seam of each panel. The cooperating and fastening material may include strips, spots, of cooperating materials that may include mating components.

Other systems, methods, aspects, features, embodiments and advantages of the invention disclosed herein will be, or will become, apparent to one having ordinary skill in the art upon examination of the following drawings and detailed description. It is intended that all such additional systems, methods, aspects, features, embodiments and advantages be included within this description, and be within the scope of the accompanying claims. This summary is provided merely to introduce certain concepts and not to identify any key or essential features of the claimed subject matter.

BRIEF DESCRIPTION OF THE DRAWINGS

It is to be understood that the drawings are solely for purpose of illustration.

Furthermore, the components in the figures are not necessarily to scale, emphasis instead being placed upon illustrating the principles of the system disclosed herein. In the figures, like reference numerals designate corresponding parts throughout the different views.

FIG. 3 shows a wearer doffing a certain embodiment of the invention;

FIG. 4 shows an expanded view of certain features of FIG. 3;

DETAILED DESCRIPTION

The following detailed description, which references to and incorporates the drawings, describes and illustrates one or more specific embodiments. These embodiments, offered not to limit but only to exemplify and teach, are shown and described in sufficient detail to enable those skilled in the art to practice what is claimed. Thus, for the sake of brevity, the description may omit certain information known to those of skill in the art.

Figure 1:
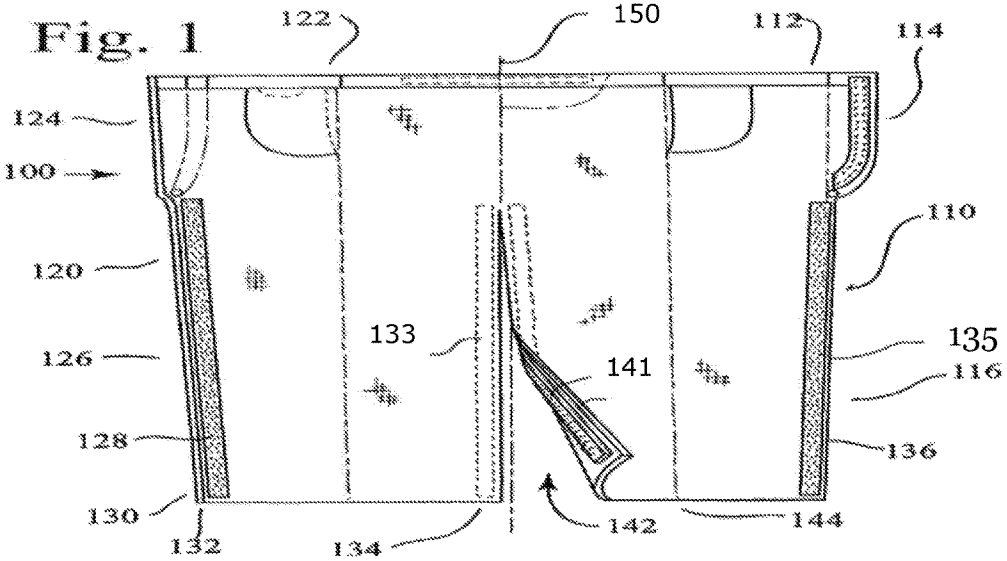
FIG. 1 shows an embodiment according to certain aspects of the invention in an open position.

FIG. 1 shows certain embodiment according to certain aspects of the present invention. A Garment 100 may include at least two panels, a right panel 110 and a left panel 120. Right panel 110 may include a waist portion 112, a hip portion 114, and a leg portion 116. Left panel 120 may include a waist portion 122, a hip portion 124, and a leg portion 126. Left panel 120 may include cooperating and fastening material 128 that may have the form of a substantially longitudinal strip 130 or semi-continuous or plurality of dots or any other forms. Strip 130 may be disposed at edge 132 in leg portion 126 of panel 120. Strip 130 may be spatially distanced from strip 134, which may include cooperating and fastening material 133. Right panel 110 may include cooperating and fastening material 135 that may be in the form of substantially continuous strip 136, or semi-continuous or plurality of dots, which may be disposed adjacent edge 140. Right panel 110 may also include fastening and cooperating materials 141 in the form of continuous or substantially continuous strip 142, which may also be in the form of plurality of dots or any other forms.

Figure 2:
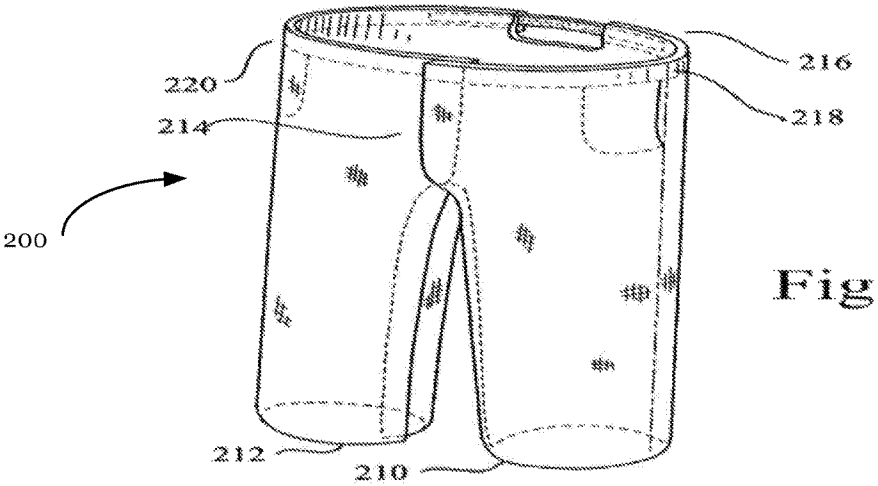
FIG. 2 shows another embodiment according to certain aspects of the invention in closed position.

FIG. 1 describes a garment 100 configured for physically challenged individuals. FIG. 1 shows garment 100 in an open position to allow individuals with physical challenges to sit on top of garment 100 aligning his left and right legs with right panel 110 and left panel 120. To turn open garment 100 to a wearable garment, the individual may match strips 130 with strip 134, and strip 136 with strip 142. It should be noted that said strips may be joined in other ways. By linking the fastening and cooperating materials, the wearer transforms the open garment into a closed wearable garment with minimum physical effort. Cooperating and fastening materials may join to form outer seams 210 and 212 as shown in FIG. 2.

Certain embodiments of the present invention may be easily donned even by wearers with physical disabilities. Once seated on garment 100 in its flat open state, all the releasable closures, for example, 114, 116, 124 and 126, are brought to the front of the wearer's body and generally proximal to the wearer's midline 150, where they are most easily accessible to either the wearer or an assistant. The frontal locations of the releasable closures, for example, the fly portion of the garment including 114 and 124 enables the wearer to access all the closures with minimal exerted force in opening and closing the garment fly. Even in the confines of a wheelchair or hospital bed, the closures are accessible and easily connected [by the hook and loop closures of 502 and 508, for example; and the magnetic components of 602, 604, 606, and 608, for example]. The wearer may be clothed by an aide or assistant without the embarrassment or effort of lifting up to position any parts of the pants underneath or around the wearer's groin area. Certain embodiments of the present invention may minimize what may be a humiliating experience undergone on a daily basis by a wearer who is physically challenged or hospitalized.

Many variations of cooperating and fastening material types and shapes may be used here. For example, cooperating and fastening materials in the shapes of points, bullets, circles, and so forth, may be used. Variety of materials may be used, such as hook and loop closures, zippers, buttons, snaps, laces, hook and eye, buckles, magnets may be hidden in the garment, electrical joints, electromagnetic contacts, thermo contact, thermoelectric contacts, snap buckles, bolt snaps, and so forth may be employed.

The present invention is adaptable to various fabrics, patterns, and textures, including fine fabrics such as silk and synthetics, or casual fabrics such as denim or corduroy, to name but a few. The releasable closures may be positioned in locations where conventional pants have fabric seams and, in the case of the fly closure, conventional zippers and buttons, so that the article of clothing of the present invention need not be readily identifiable as specialized clothing.

FIG. 2 shows certain embodiments of the present invention in a second wearable closed position. A wearer may join parts of hip portion 114 to mating portion 124, leg portion 116 to portion 126 forming outer seam 210 and 212 and creating waist portion 216 and crotch region 214, and thereby forming a garment 200 around wearer's body without the need to move or twist wearer's body to don article of clothing. Waist portion 216 may include substantially continuous elastic strip 218 that may extend inside outer top edge 220.

FIG. 3 shows some uses of certain embodiments of the article of clothing of the present invention 300. A wearer 310 may be an individual with certain physical challenges. After donning article of clothing 300, wearer 310 may need to undergo certain medical or physical tests. Wearer 310 may easily expose any bodily parts by releasing outer seams 210 and/or 212, which may form a continuous outer seam in certain embodiments. Wearer 310 may expose certain bodily parts without having to move or twist his body and without the need for assistance from others. In FIG. 3, outer seam is shown as Velcro cooperating and fastening materials 320. However, variety of designs and materials may be used. For example, cooperating and fastening materials in the shapes of points, bullets, circles, and so forth, may be used. Variety of materials may be used, such as Velcro, zippers, buttons, snaps, laces, hook and eye, buckles, magnets may be hidden in the garment, electrical joints, electromagnetic contacts, thermo contact, thermoelectric contacts, snap buckles, bolt snaps, and so forth may be employed.

FIG. 4 shows certain embodiment 400 having alternative cooperating and fastening materials 410 including plurality of releasably engaging teeth 412 and 414 to allow wearer 310 to releasably engage and disengage teeth 412 and 414 as desired to expose needed bodily parts for treatment and/or medical attention.

Figure 5:
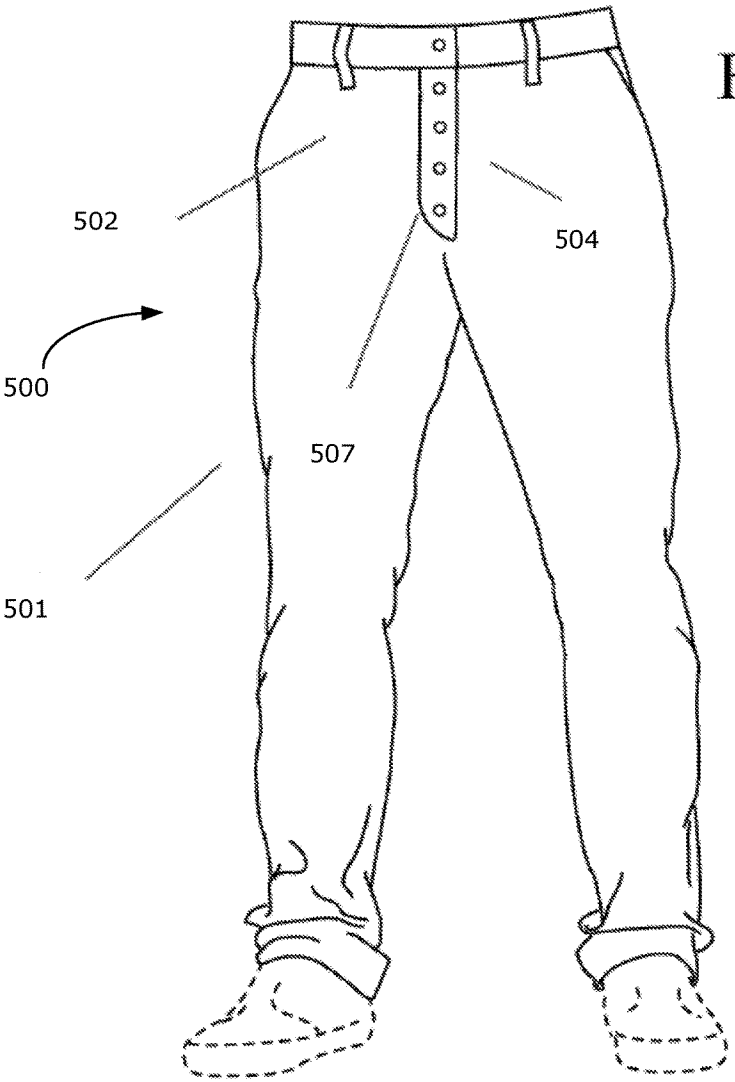
FIG. 5 shows another embodiment according to some aspects of the invention.

FIG. 5 shows another embodiment 500 according to certain aspects of the present invention in a closed position. Pants 500 may include a fly portion 502, shown in a closed position 504. Fly portion 502 may include a plurality of cooperating elements 507 shown in detail in the following figure, FIG. 6.

Figure 6:
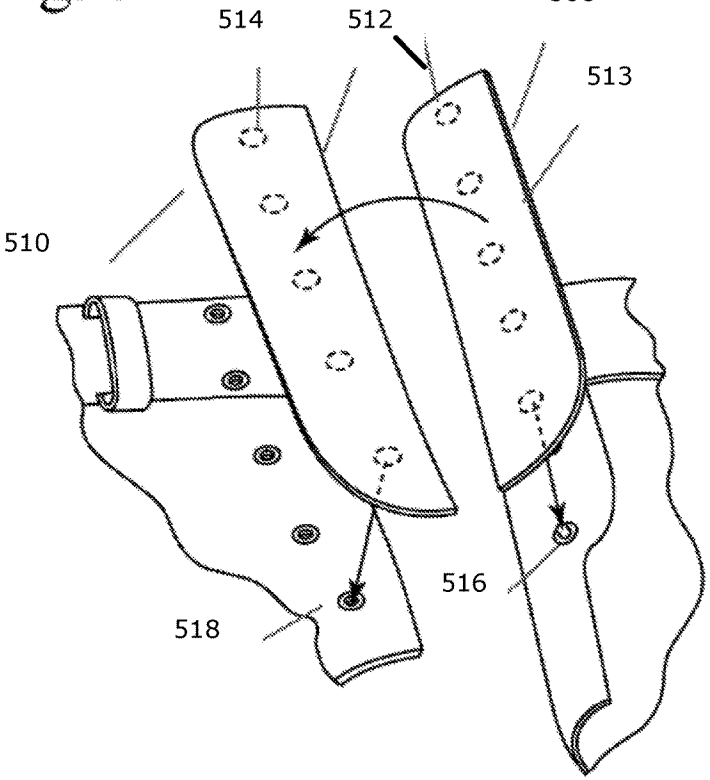
FIG. 6 shows some aspects of the embodiment shown in FIG. 5.

FIG. 6 shows fly portion 502 in an open position. Cooperating elements 507 may include a plug 512 or plurality of plugs on one side 508 of fly portion 502, and corresponding plurality of jacks 514 on the other side 510 of fly portion 502. A wearer can easily open or close fly portion 502 by bringing together plugs 512 and jacks 514 that may operate in snap mechanism or pulling them apart. A wearer with physical challenges can easily open or close the entire fly portion 502 in a quick manner in a hospital or medical environment settings. Additional cooperating elements 516 on side 512 and corresponding elements 518 on side 514 may also be added to allow the wearer to undo or do any portion of pants 501. Pants 501 may consists entirely of cooperating elements 507 spread out across pants 501 to allow wearer to release any portion of pants 501. Cooperating elements are not limited to snap mechanisms and may include hook and loop, zippers, buttons, laces, hook and eye, buckles, magnets, electrical joints, electromagnetic contacts, thermo contact, thermoelectric contacts, and so forth.

Figure 7:
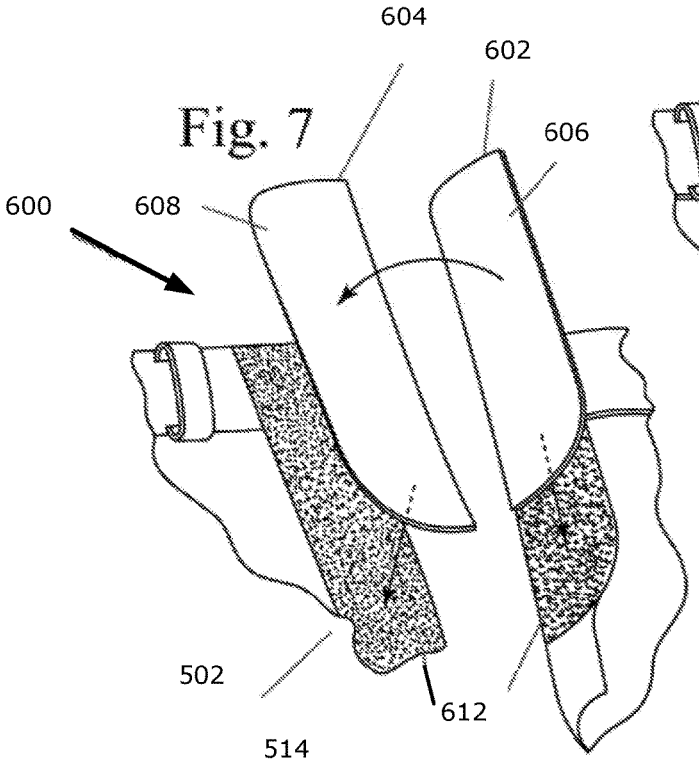
FIG. 7 shows an alternative embodiment of some aspects of the invention disclosed in FIG. 5.

FIG. 7 shows embodiment 600 according to certain aspects of the present invention. Pants 501 may include fly portion 502 configured to allow physically challenged persons to easily open or close desired portions of pants 501 to respond to medical or physiological needs. Embodiment 600 may include at least two portions, a right portion 602 and a left portion 604. Portions 602 and 604 may be rectangular, elliptical, or any other shape. Preferably portions 602 and 602 have complimentary shapes. Portion 602 may include releasably coupling mechanism 606 and portion 604 may include releasably coupling mechanism 608. Releasable coupling mechanisms may include hook and loop or similar equivalent couplings. Pants 501 may include a plurality of coupling mechanisms. Pants 501 may be formed entirely from coupling mechanisms 610 and/or 612 allowing physically challenged persons to releasably attached or detach any portions of pants 501.

Figure 8:
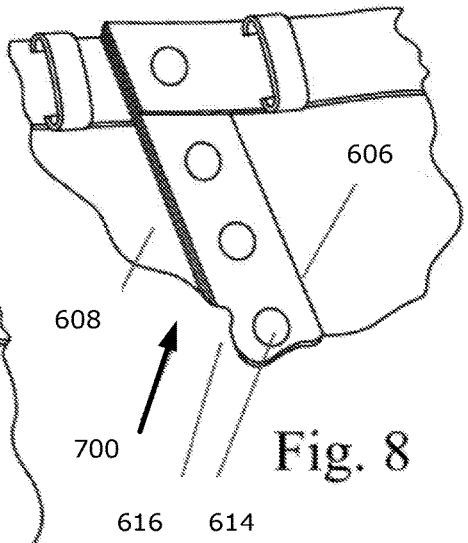
FIG. 8 shows some aspects of the embodiment shown in FIG. 5.

FIG. 8 shows closed position 700 of pants 501. Portion 606 is shown coupled to portion 608. A coupling mechanism here may include snap button 614 and corresponding button or magnetic component 616 on the other side. A plurality of snap buttons may be used across pants 501.

Figure 9:
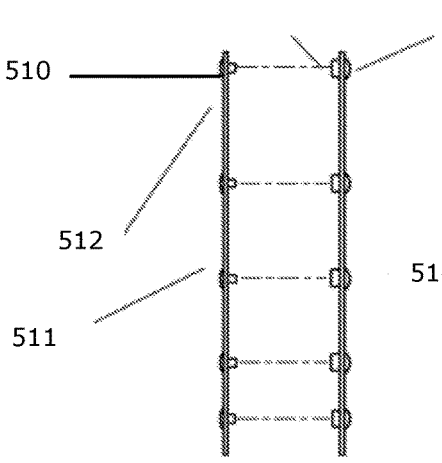
FIG. 9 shows a side view of certain embodiment disclosed in FIG. 6.

FIG. 9 shows a side view of an embodiment disclosed in FIG. 6. Portion 510 may include a plurality of snap bolts or magnetic components 512 spaced apart along portion 510 and a plurality of corresponding snap bolts or magnetic components 514 spaced apart on portion 508 along vertical strips 511.

Figure 10:
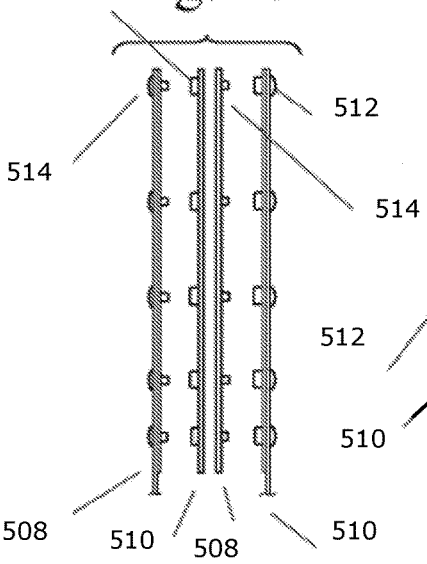
FIG. 10 shows a side view of certain embodiment disclosed in FIG. 6 in an open position.

FIG. 10 shows another embodiment including a plurality of snap bolts or magnetic components 514 and 512 disposed on vertical strips 511 in an open position.

Figure 11:
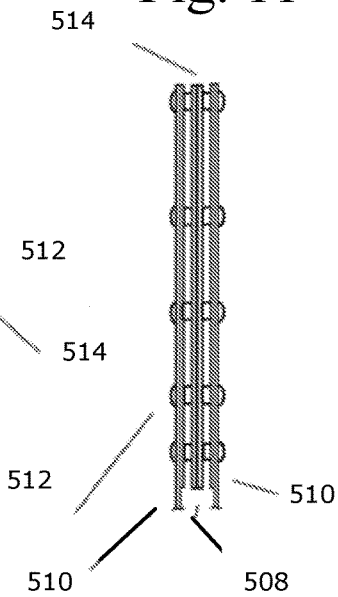
FIG. 11 shows a side view of certain embodiment disclosed in FIG. 6 in a closed position.

FIG. 11 shows snap bolts or magnetic components 514 and 512 in a closed position releasably securing portions 508 and 510 of fly portion 502.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make and use the invention, and not necessarily to limit the scope of legal protection afforded the appended claims.

The above description of the disclosed embodiments is provided to enable any person skilled in the art to make or use that which is defined by the appended claims. The following claims are not intended to be limited to the disclosed embodiments. Other embodiments and modifications will readily occur to those of ordinary skill in the art in view of these teachings. Therefore, the following claims are intended to cover all such embodiments and modifications when viewed in conjunction with the above specification and accompanying drawings.

What is claimed is:

1. A self-donning apparel comprising:

a pair of pants, said pair of pants comprising a right panel and a left panel, wherein the right panel includes a right fly panel, a right waist portion, a right hip portion, and a right leg portion, wherein the left panel includes a left fly panel, a left waist portion, a left hip portion, and a left leg portion, wherein each of the right panel and the left panel includes cooperating and fastening material at the left and right fly panels, an inside edge of each of the right and left leg portions, and an outside edge of each of the right and left leg portions, wherein the inside edge and outside edge of the right leg portion join to form a detachable seam at the right leg portion, and the inside edge and outside edge of the left leg portion join to form a detachable seam at the left leg portion;

wherein the right fly panel includes a right longitudinal panel and the left fly panel includes a left longitudinal panel, the right and left longitudinal panels each having a bottom surface and a top surface, the bottom surfaces of each of the longitudinal panels including additional cooperating and fastening material, such that the additional cooperating and fastening material of bottom surface of the right longitudinal panel is detachably attached to the cooperating and fastening material of the right fly panel, and the additional cooperating and fastening material of the bottom surface of the left longitudinal panel is detachably attached to the cooperating and fastening material of the left fly panel, and the top surface of the right longitudinal panel is detachably attached to the top surface of the left longitudinal panel via magnetic components comprising a set of magnets, to close the fly panel.

2. The self-donning apparel of claim 1, wherein the left longitudinal panel and the left fly panel each include a proximal end flush with the left waist portion and a distal end flush with an end of the inside edge of the left leg portion, and the right longitudinal panel and the right fly panel each include a proximal end flush with the right waist portion and a distal end flush with an end of the inside edge of the right leg portion.

3. The self-donning apparel of claim 1, wherein the additional cooperating and fastening material includes a hook and loop closure.

4. The self-donning apparel of claim 1, wherein the magnetic components on each longitudinal panel are opposite in polarity.

5. The self-donning apparel of claim 3, wherein the magnetic components are spaced along the length of the longitudinal panels.

6. The self-donning apparel of claim 1, wherein the set of magnets is four magnets.

* * * * *